US007574150B2

(12) United States Patent
Eom

(10) Patent No.: US 7,574,150 B2
(45) Date of Patent: Aug. 11, 2009

(54) POWER CONTROL APPARATUS AND METHOD OF USING A POWER CONTROL APPARATUS IN AN IMAGE FORMING DEVICE

(75) Inventor: Yoon-seop Eom, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 96 days.

(21) Appl. No.: 11/704,218

(22) Filed: Feb. 9, 2007

(65) Prior Publication Data

US 2008/0019709 A1 Jan. 24, 2008

(30) Foreign Application Priority Data

Jul. 20, 2006 (KR) ..... 10-2006-0068090

(51) Int. Cl.
*G03G 15/00* (2006.01)
*G03G 13/04* (2006.01)
*B41J 2/385* (2006.01)

(52) U.S. Cl. ..... 399/13; 399/88; 399/90; 347/129

(58) Field of Classification Search ..... 399/9, 399/13, 88, 90, 121; 347/129
See application file for complete search history.

(56) References Cited

U.S. PATENT DOCUMENTS 5,201,854 A * 4/1993 Ahl et al. ..... 399/90 X
5,283,597 A * 2/1994 Yoshida et al. ..... 399/13 X
6,647,223 B2 * 11/2003 Ishii ..... 399/90
2006/0120746 A1 6/2006 Lee et al.

FOREIGN PATENT DOCUMENTS

CN 1786849 A 6/2006
EP 0271720 6/1988

OTHER PUBLICATIONS

Office Action issued in corresponding European Patent Application No. 07104340.0 dated Nov. 12, 2007.
Chinese Office Action issued in Chinese Application No. 200710088712.3 on Jan. 9, 2009.

* cited by examiner

*Primary Examiner*—Sandra L Brase
(74) *Attorney, Agent, or Firm*—Stein McEwen, LLP

(57) ABSTRACT

A method and apparatus to control power supplied to a paper transfer belt (PTB) unit and a laser scanning unit (LSU) included in an image forming device includes the PTB unit to transfer a developed latent image onto a printing medium, the LSU to scan light onto a photosensitive medium, a first controller to control power supplied to the PTB unit and the LSU, and a connection unit to connect the PTB unit to the first controller, wherein the first controller controls the power supplied to the LSU according to a connection state of the connection unit.

29 Claims, 8 Drawing Sheets

POWER CONTROL APPARATUS AND METHOD OF USING A POWER CONTROL APPARATUS IN AN IMAGE FORMING DEVICE

CROSS-REFERENCE TO RELATED APPLICATION

This application claims the benefit of Korean Application No. 2006-68090, filed Jul. 20, 2006, in the Korean Intellectual Property Office, the disclosure of which is incorporated herein by reference.

BACKGROUND OF THE INVENTION

1. Field of the Invention

Aspects of the present invention relate to an electrographic image forming device, and more particularly, to a method and apparatus to control power supplied to a paper transfer belt (PTB) unit and a laser scanning unit (LSU) according to whether a cover of an image forming device is open or closed and whether the PTB unit is installed within the image forming device.

2. Description of the Related Art

In an image forming device, when a paper jam, in which printing paper fed by a paper transfer belt (PTB) unit is jammed in a transfer belt, occurs, a user generally cannot remove the jammed paper until after opening an outer cover of the image forming device. Similarly, when the transfer belt, which is a replaceable part, must be changed, a user cannot replace the transfer belt until after separating the PTB unit from the image forming device. As illustrated in FIG. 1, if a laser scanning unit (LSU) which scans a laser beam onto a photosensitive medium faces the outer cover of the image forming apparatus, a laser beam may be irradiated on the eyes of the user when the user opens the outer cover of the image forming device or separates the PTB unit from the image forming device.

In order to prevent this problem whereby a laser beam scanned by the LSU is irradiated on the eyes of the user, the conventional image forming device generally includes a device to block the laser beam so that the laser beam is not exposed to the user. In particular, if a laser beam is irradiated on the eyes of the user, various problems may occur, such as the laser beam distracting the user. Thus, various kinds of standards require image forming devices to include a device which double blocks the laser beam irradiated by the LSU.

FIG. 1 is a side view of an image forming device having a conventional power control apparatus. The image forming device in FIG. 1 may be a copier, a facsimile machine, a multi-function unit, etc. Referring to FIG. 1, an LSU 100 scans light to form an electrostatic latent image onto a photosensitive medium 110. A PTB unit 120 feeds a recording medium, such as printing paper, into the image forming device and transfers a developed latent image onto the recording medium. An outer cover 130 allows a user to open or close the image forming device from the outside so that the user can remove jammed recording media from the PTB unit 120 and/or separate the PTB unit 120 from the image forming device by allowing access to the inside of the image forming device.

A first micro-switch 140 and a second micro-switch 150 are devices to cut off power supplied to the LSU 100 in response to the opening of the outer cover 130. The LSU shutter 160 is a device which blocks a laser beam scanned by the LSU 100 in response to the opening of the outer cover 130.

FIGS. 2A and 2B are block diagrams of conventional power control apparatuses. These conventional power control apparatuses are generally housed within conventional image forming devices, such as the conventional image forming device shown in FIG. 1.

In the conventional power control apparatus illustrated in FIG. 2A, a power controller 170 receives electrical power of +24V and +5V generated by a power supply unit 180 and transmits the received electrical power of +24V and +5V to the LSU 100 via the first micro-switch 140 and the second micro-switch 150, respectively. The first micro-switch 140 and the second micro-switch 150 are both turned on when the outer cover 130 is closed, and are both turned off when the outer cover 130 is opened. Thus, when a user opens the outer cover 130, the first micro-switch 140 turns off, thereby cutting off the electrical power of +24V supplied to a motor 102 of the LSU 100, and the second micro-switch 150 also turns off, thereby cutting off the electrical power of +5V supplied to a laser diode (LD) 104 of the LSU 100. The power controller 170 generates electrical power of +3.3V using the electrical power supplied by the power supply unit 180 and provides the generated electrical power of +3.3V to various kinds of sensors and memory units included in the PTB unit 120.

Unlike the conventional power control apparatus illustrated in FIG. 2A, which has two micro-switches 140 and 150, the conventional power control apparatus illustrated in FIG. 2B has only one micro-switch 140 and an LSU shutter 160 which blocks a laser beam scanned by the LSU 100. Since the components of the conventional power control apparatus illustrated in FIG. 2B are the same components as the components of the conventional power control apparatus illustrated in FIG. 2A except for the LSU shutter 160, only the LSU shutter 160 will be described. As shown in FIG. 1, the LSU shutter 160 is installed next to the LSU 100 near an opening through which a laser beam is irradiated. When a user opens the outer cover 130, a lever operating in conjunction with the opening and closing of the outer cover 130 causes the LSU shutter 160 to block the laser beam. Thus, when a user opens the outer cover 130, the LSU shutter 160 blocks a laser beam from irradiating outside of the image forming device.

As described above, the conventional power control apparatus illustrated in FIG. 2A has a first micro-switch 140 and a second micro-switch 150. The first micro-switch 140 and second micro-switch 150 are both turned on when the outer cover 130 is closed, and are both turned off when the outer cover 130 is opened, in order to support double blocking of a laser beam according to a specification. The conventional power control apparatus illustrated in FIG. 2A has several drawbacks. Since a plurality of micro-switches must be installed, the space required to install the plurality of micro-switches is large, the manufacturing costs of the conventional power control apparatus are high, and the mechanical embodiment is complicated.

Furthermore, the conventional control apparatus illustrated in FIG. 2B also has drawbacks. Although the design of the conventional power control apparatus illustrated in FIG. 2B reduces the number of micro-switches to only one, this design additionally requires the LSU shutter 160. For an image forming device using a single path method, since laser beams to which yellow, magenta, cyan, and black images are exposed must all be blocked, the conventional power control apparatus illustrated in FIG. 2B must have at least four LSU shutters 160, resulting in a spatial problem and high manufacturing costs.

Moreover, in the conventional power control apparatuses illustrated in FIGS. 2A and 2B, even though electrical power supplied to the LSU 100 is cut off when the outer cover 130

(FIG. 1) is opened, electrical power is continuously supplied to the PTB unit 120. This continuous supply of electrical power to the PTB unit 120 causes glitch noise to occur due to an instantaneous unstable contact when the outer cover 130 is closed, causing malfunctions of the various kinds of sensors and memory units included in the PTB unit 120.

SUMMARY OF THE INVENTION

Aspects of the present invention provide a power control apparatus and method of using a power control apparatus in an image forming device, which has reduced manufacturing costs and an efficient layout, by simplifying a configuration in which a connection state of a paper transfer belt (PTB) unit is sensed, through the implementation of a simple method using a feedback signal of power supplied to the PTB unit and power supplied to a laser scanning unit (LSU), wherein the power control apparatus is controlled according to the sensed connection state of the PTB unit.

Additional aspects and/or advantages of the invention will be set forth in part in the description which follows and, in part, will be obvious from the description, or may be learned by practice of the invention.

Aspects of the present invention also provide a power control apparatus and method of using a power control apparatus in an image forming device to control power supplied to various kinds of sensors and memory units included in a PTB unit in a stable fashion, according to the opening and closing of an outer cover of an image forming device, in order to prevent the sensors and memory units included in the PTB unit from operating incorrectly and/or operating out of order due to a mistake of a user, when the image forming device abnormally operates due to the opening and closing of the outer cover.

Aspects of the present invention also provide a power control apparatus and a method of using a power control apparatus in an image forming device, wherein the apparatus and method are competitively priced and efficiently structured by simplifying a configuration to control various kinds of sensors and memory units included in a PTB unit.

According to an aspect of the present invention, a power control apparatus includes a PTB unit to transfer a developed latent image onto a printing medium, an LSU to scan light onto a photosensitive medium, a first controller to control power supplied to the PTB unit and the LSU, and a connection unit to connect the PTB unit to the first controller, wherein the connection unit is used to install the PTB unit in an image forming device and connects the PTB unit and the first controller in conjunction with the installation of the PTB unit. According to an aspect of the present invention, the first controller may receive a first signal according to a connection state of the connection unit and control the power supplied to the LSU in response to the first signal, wherein the first signal is a feedback signal of the power transmitted from the first controller to the PTB unit.

According to an aspect of the present invention, the power control apparatus may further include a switch which is respectively turned on and off when a cover is closed and opened, wherein the first controller senses the opening and closing of the cover using a second signal received from the switch, and controls the power supplied to the LSU according to a sensing result.

According to an aspect of the present invention, the power control apparatus may further comprise a second controller to turn the first controller on and off according to the first and second signals.

According to an aspect of the present invention, the PTB unit may include a plurality of sensors, wherein the first controller transmits power supplied to the plurality of sensors along with a control signal to control the plurality of sensors, and receives output signals outputted from the plurality of sensors. According to an aspect of the present invention, the first controller may further include a multiplexer to output a control signal corresponding to a selected sensor among the control signals in response to a selection signal to select one sensor among the plurality of sensors, the connection unit may transfer the control signal corresponding to the selected sensor and the selection signal to the PTB unit, and the PTB unit may further include a demultiplexer to output the control signal corresponding to the selected sensor to the sensor selected among the plurality of sensors in response to the selection signal.

According to another aspect of the present invention, a method of controlling power supplied to a PTB unit and an LSU includes sensing whether the PTB unit is installed in the image forming device; and controlling power supplied to the PTB unit and the LSU according to a sensing result. According to another aspect of the present invention, sensing whether the PTB unit is installed may include transmitting a portion of the power to the PTB unit, feeding back the portion of the power applied to the PTB unit; and sensing whether the PTB unit is installed in the image forming device according to a feedback result.

The method according to another aspect of the present invention may further include sensing an opening and closing of a cover disposed in the image forming device, and the feeding back of the portion of the power applied to the PTB unit may further include cutting off the power supplied to the PTB unit and the LSU if the results sensed during the sensing of whether the PTB unit is installed and during the sensing of an opening and closing of a cover indicate either that the PTB unit is not installed or that the cover is open.

According to another aspect of the present invention, the controlling of the power supplied to the PTB unit and the LSU according to the sensing result may further include, if the PTB unit comprises a plurality of sensors, cutting off power and control signals transmitted to the plurality of sensors according to the sensing results.

According to another aspect of the present invention, a computer readable recording medium stores a computer readable program to execute the power control method.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
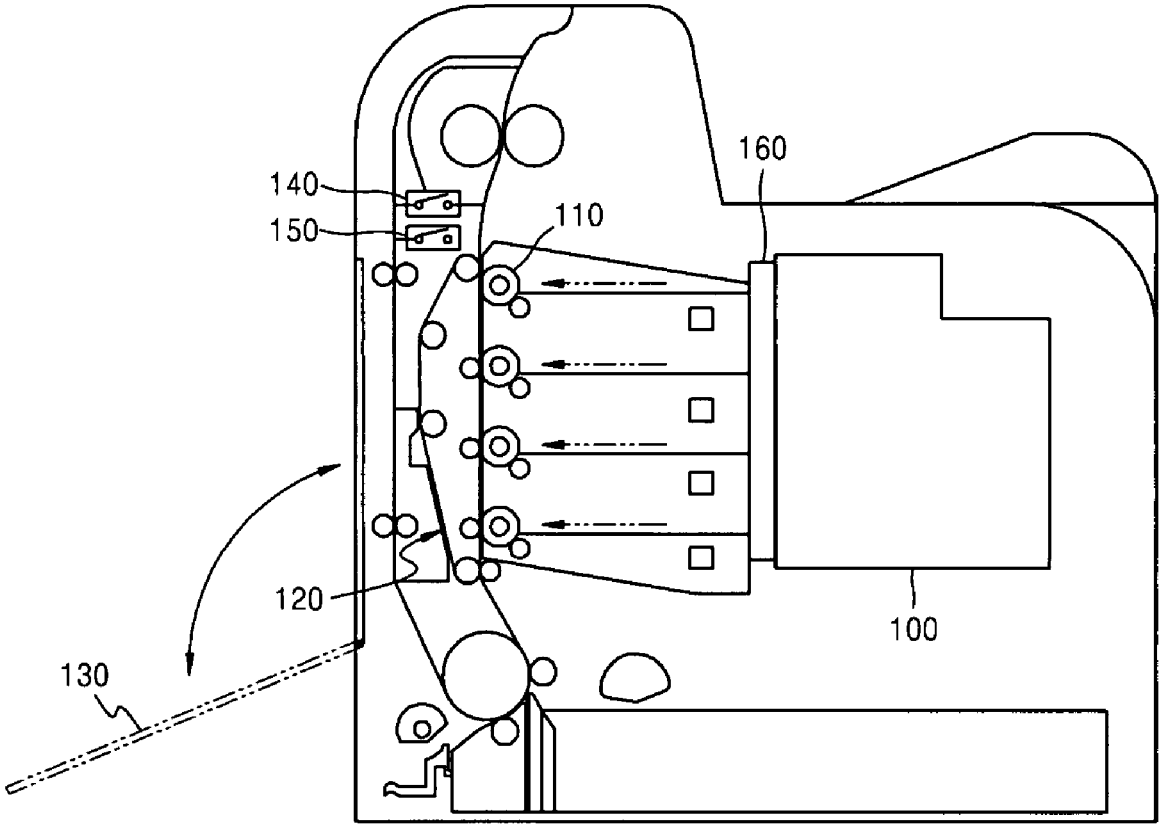
FIG. 1 (PRIOR ART)
FIG. 1 is a side view of an image forming device which has a conventional power control apparatus.
Figure 2A:
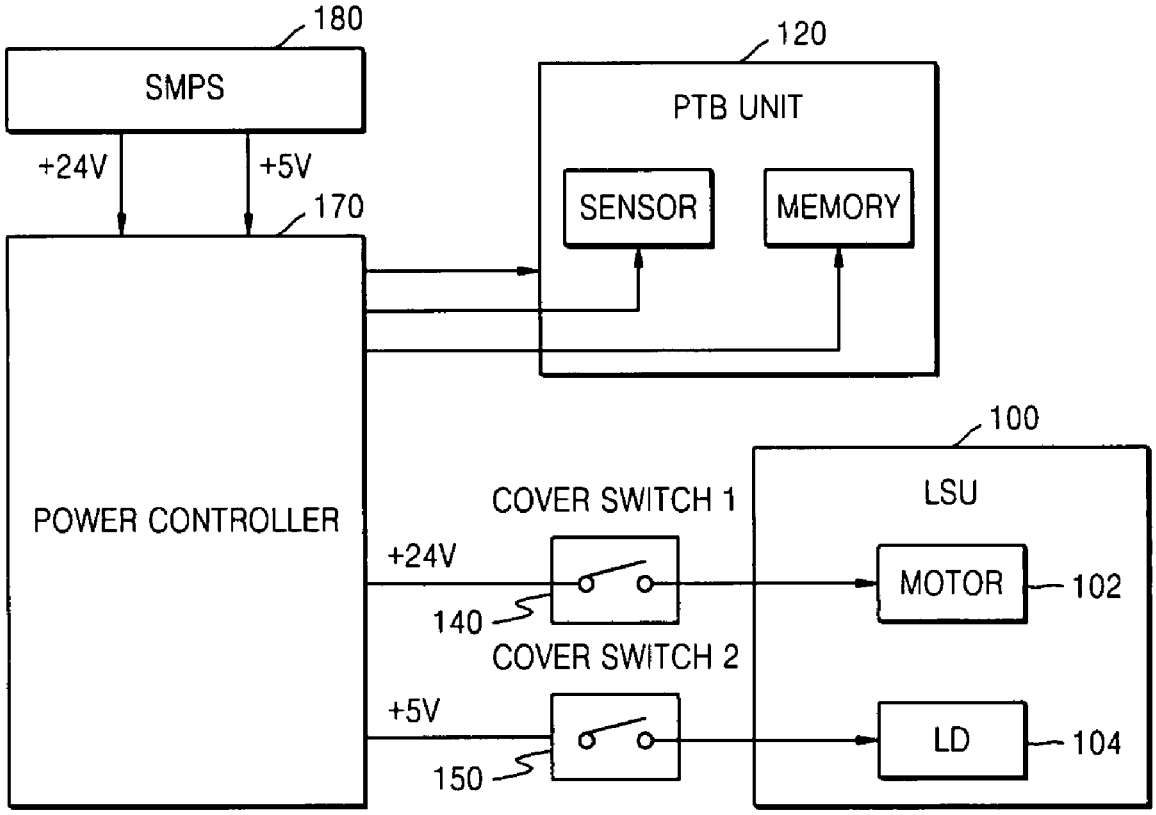
FIG. 2A (PRIOR ART)
FIG. 2A is a block diagram of the conventional power control apparatus used in the image forming device of FIG. 1.
Figure 2B:
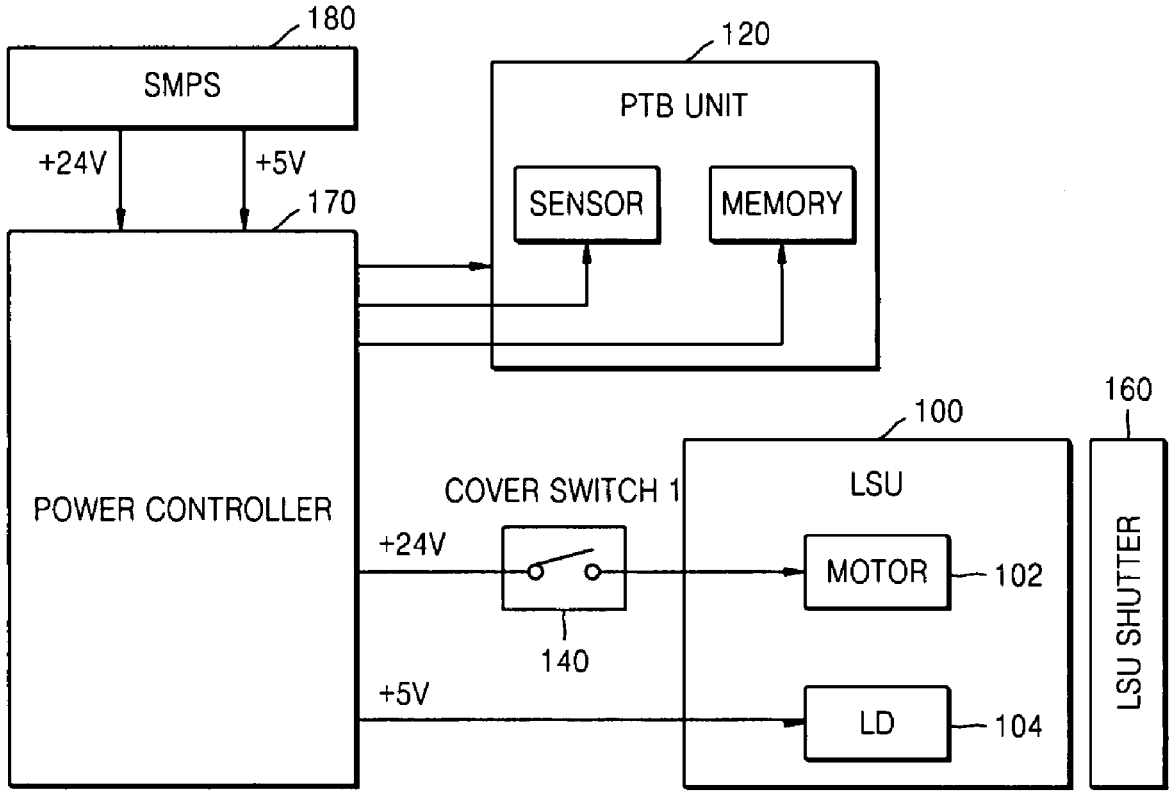
FIG. 2B (PRIOR ART)
FIG. 2B is another block diagram of the conventional power control apparatus used in the image forming device of FIG. 1.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 3:
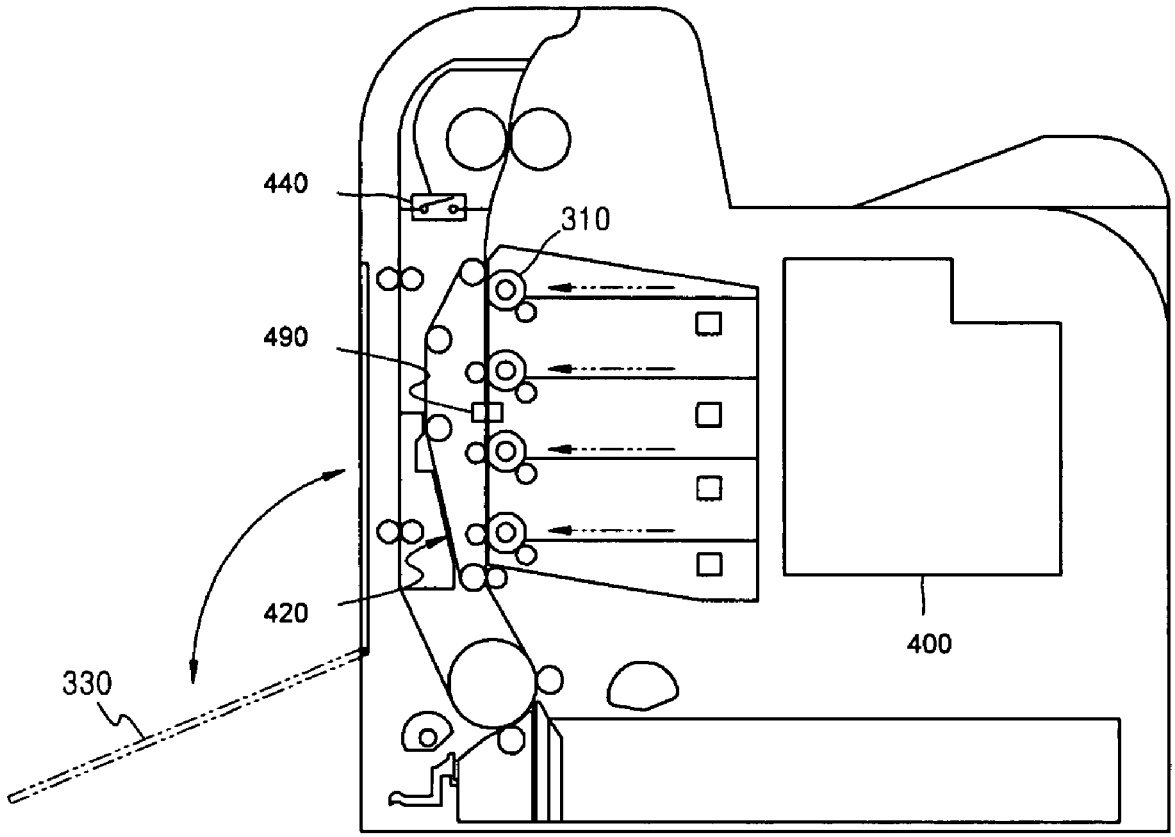
FIG. 3 is a side view of an image forming device which has a power control apparatus according to an embodiment of the present invention.

FIG. 3 is a side view of on image forming device which has a power control apparatus according to an embodiment of the present invention. The image forming device in FIG. 3 includes a light scanning unit (LSU) 400, a photosensitive medium 310, a paper transfer belt (PTB) unit 420, an outer cover 330, a cover switch 440, and a connection unit 490.

Figure 4:
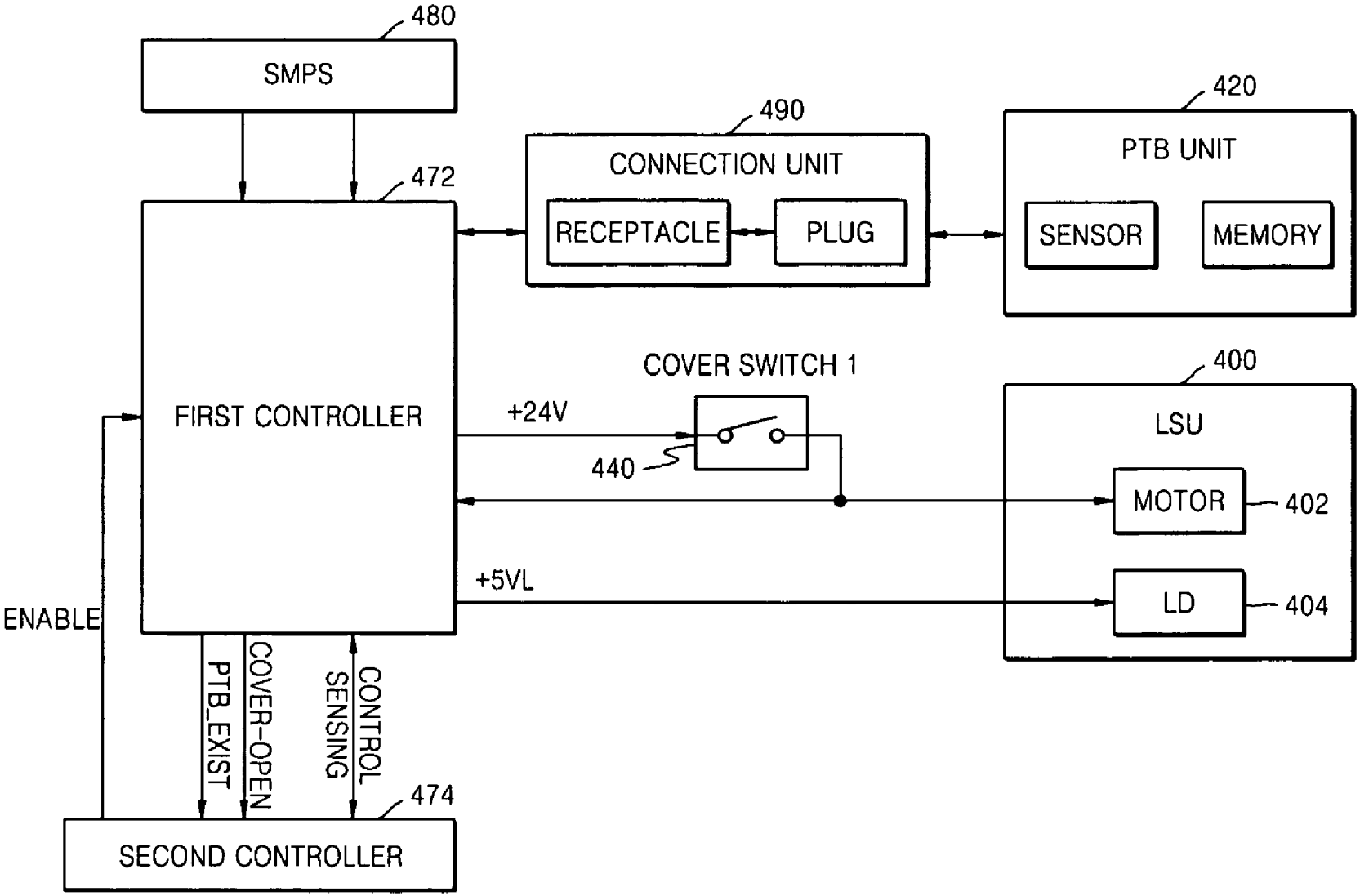
FIG. 4 is a block diagram of a power control apparatus according to an embodiment of the present invention.

FIG. 4 is a block diagram of a power control apparatus according to an embodiment of the present invention. Referring to FIG. 4, the power control apparatus includes the laser scanning unit (LSU) 400, the paper transfer belt (PTB) unit 420, the connection unit 490, a first controller 472, a second controller 474, the cover switch 440, and a power supply unit 480. The LSU 400 includes a laser diode (LD) 404 to scan light onto a photosensitive medium and a motor 402 to drive the LD 404. The first controller 472 transmits electrical power of +5V and +24V to the LSU 400. The LSU 400 in turn transmits the electrical power of +5V to the LD 404, and transmits the electrical power of +24V to the motor 402.

Figure 5:
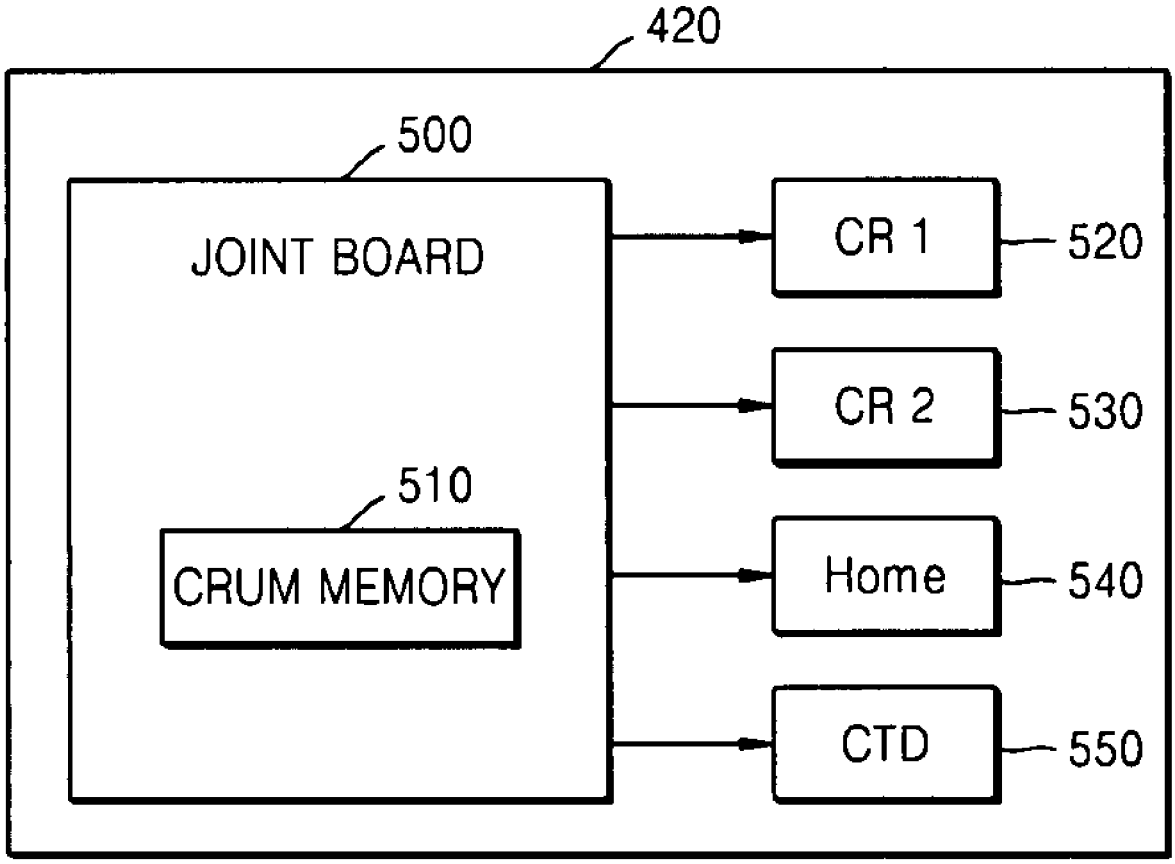
FIG. 5 is a block diagram of a paper transfer belt (PTB) unit included in the power control apparatus illustrated in FIG. 4, according to an embodiment of the present invention.

The PTB unit 420 feeds a printing medium along a predetermined transfer path of the image forming device, in order to transfer a developed latent image onto the printing medium. The printing medium may be paper, transparency sheets, etc. When a printing medium is picked up from a cassette (not shown), the PTB unit 420 develops an image onto the printing medium while the printing medium is moved along the predetermined transfer path, fixes the developed image, and discharges the printing medium. Referring to FIG. 5, the PTB unit 420 includes various components, such as sensors 520, 530, 540 and 550 used during the process of transferring the developed latent image onto the printing medium, a memory 510, and a joint board 500 joining the sensors 520, 530, 540 and 550 and the memory 510 together. In an embodiment of the PTB unit shown in FIG. 5, the sensors are color registration sensors 520 and 530, a home detection optical sensor 540, and a conductivity temperature depth (CTD) sensor 550. It is understood that other types of sensors may be used instead of, or in addition to, the sensors shown in FIG. 5. The memory 510 may be installed in the joint board 500, although the memory 510 may also be installed outside of the joint board 500. The sensors 520, 530, 540 and 550, along with the memory 510, will be described later.

The connection unit 490 connects the PTB unit 420 to the first controller 472 in conjunction with the installation of the PTB unit 420. Since the PTB unit 420 is preferably a replaceable part, the PTB unit 420 may preferably be designed to have a structure which allows a user to easily install and remove the PTB unit 420 after opening an outer cover 330 of an image forming device, as shown in FIG. 3. The connection unit 490 may preferably be used to install the PTB unit 420 inside the image forming device and simultaneously be used to connect the installed PTB unit 420 to the first controller 472. Thus, the connection unit 490 preferably has a structure which includes a plug and a receptacle, along with a drawer connector having a guide groove, so that the PTB unit 420 can be easily installed and removed from the image forming device.

According to an embodiment of the present invention, the connection unit 490 connects the PTB unit 420 to the first controller 472 when the PTB unit device is installed into the image forming device, and disconnects the PTB unit 420 from the first controller 472 when the PTB unit 420 is removed from the image forming device.

Due to this characteristic of the connection unit 490 according to an embodiment of the present invention, the first controller 472 senses whether the PTB unit 420 is installed in the image forming device by using a feedback signal of electrical power applied to the PTB unit 420. If the PTB unit 420 is installed in the image forming device, the first controller 472 transmits electrical power of +5V to the PTB unit 420, and if the transmitted electrical power of +5V is then fed back to the first controller 472 via the connection unit 490, a feedback signal of +5V is input to the first controller 472. If the PTB unit 420 is not installed in the image forming device, the electrical power of +5V transmitted by the first controller 472 cannot be transmitted to the PTB unit 420, and thus the feedback signal of +5V cannot be fed back to the first controller 472 from the PTB unit 420.

In an embodiment of the PTB unit 420, the connection unit 490 is installed using a drawer connector, and the electrical power transmitted to the PTB unit 420 by the first controller 472 is then fed back to the first controller 472 using a harness pin attached to the drawer connector. In another embodiment of the PTB unit 420, the joint board 500 of the PTB unit 420 is installed using a printed circuit board (PCB). In this other embodiment, the electrical power transmitted to the PTB unit 420 by the first controller 472 is fed back to the first controller 472 using a detour pattern of the joint board 500. One skilled in the art would understand that there are other ways to install the PTB unit 420 besides these two above-described embodiments.

The connection unit 490 transfers electrical power transmitted by the first controller 472, along with control signals of the sensors 520, 530, 540 and 550, to the PTB unit 420, and transfers signals generated by the PTB unit 420, e.g., output signals which output results sensed by the sensors 520, 530, 540 and 550, back to the first controller 472. Thus, instead of sensing whether the PTB unit 420 is installed in the image forming device by using the feedback signal of electrical power applied to the PTB unit 420, the installation of the PTB unit 420 may instead be sensed according to whether signals outputted from the sensors 520, 530, 540 and 550 and the memory 510, each of which is preferably included in the PTB unit 420, are inputted to the first controller 472.

The cover switch 440 is a micro-switch that is turned on and off when the outer cover 330 is closed and opened, respectively. The first controller 472 transmits electrical power of +24V to the cover switch 440, wherein an output signal of the cover switch 440 is transmitted to the motor 402 included in the LSU 400. The output signal of the cover switch 440 is also fed back to the first controller 472. The first controller 472 receives the electrical power of +24V from the power supply unit 480 and applies the electrical power of +24V to the cover switch 440. If the outer cover 330 of the image forming device is closed, the cover switch 440 is in an "on state," and thus, the output signal of the cover switch 440 is transmitted to the motor 402 included in the LSU 400 and then fed back to the first controller 472. If the outer cover 330 of the image forming device is open, the cover switch 440 is in an "off" state, and therefore, the electrical power of +24V is not fed back to the first controller 472.

Thus, the first controller 472 senses whether the outer cover 330 is open or closed using the feedback signal of +24V received from the cover switch 440. Specifically, if the electrical power of +24V transmitted to the cover switch 440 by the first controller 472 is fed back to the first controller 472 via the cover switch 440, the first controller 472 determines that the outer cover 330 is closed. On the other hand, if the electrical power of +24V transmitted to the cover switch 440 by the first controller 472 is not fed back to the first controller 472, the first controller 472 determines that the outer cover 330 is open.

The power supply unit 480 generates electrical power which is supplied to the PTB unit 420 and the LSU 400. The power supply unit 480 may preferably be implemented as a switch mode power supply (SMPS), but it is understood that other types of power supplies may be used instead of an SMPS. The SMPS 480 generates the electrical power of +24V to drive the motor 402 of the LSU 400, and also generates the electrical power of +5V to drive other electrical parts in the image forming device, such as the LD 404. Furthermore, the power supply unit 480 supplies the generated electrical power of +24V and +5V to the first controller 472, and in turn, the first controller 472 controls and transmits the electrical power supplied by the power supply unit 480 to the PTB unit 420 and the LSU 400.

The first controller 472 senses whether the PTB unit 420 is installed in the image forming device using the feedback signal (hereinafter referred to as a first signal) received from the connection unit 490 and senses the opening and closing of the outer cover 330 using the feedback signal (hereinafter referred to as a second signal) received from the cover switch 440. The first controller 472 controls the power supplied to the PTB unit 420 according to whether the PTB unit 420 is installed and whether the outer cover 330 is open or closed by using these first and second signals.

If the first controller 472 detects that both the first and second signals are high, the first controller 472 determines that the PTB unit 420 is installed in the image forming device and determines that the outer cover 330 is closed. In this case, the first controller 472 transmits the electrical power received from the power supply unit 480 to the LD 404 of the LSU 400. On the other hand, if the first controller 472 detects that either the first and/or second signal is low, the first controller 472 determines that the PTB unit 420 is not installed and/or the outer cover 330 is open. In this case, the first controller 472 cuts off the power supplied to the LD 404 of the LSU 400.

The first controller 472 outputs a 'PTB_EXIST' signal to indicate the existence of the PTB unit 420 within the image forming device, which is sensed using the first signal, and a 'COVER_CLOSED' signal to indicate whether the outer cover 330 is opened or closed, which is sensed using the second signal, to the second controller 474. In an embodiment of the present invention, the first controller 472 may be implemented as a micom controller. However, the first controller 472 is not limited to being a micom controller, and it will be understood by those of ordinary skill in the art that the first controller 472 may also be implemented using other methods.

The second controller 474 receives the 'PTB_EXIST' signal and the 'COVER_CLOSED' signal from the first controller 472 and turns on or off the first controller 472 according to the 'PTB_EXIST' signal and the 'COVER_CLOSED' signal. According to an embodiment of the present invention, the 'PTB_EXIST' signal is an "on" signal if the PTB unit 420 is installed, i.e., if the first signal is high, and is an "off" signal if the PTB unit 420 is not installed, i.e., if the first signal is low. In addition, the 'COVER_CLOSED' signal is an "on" signal if the outer cover 330 is closed, i.e., if the second signal is high, and is an "off" signal if the outer cover 330 is open, i.e., if the second signal is low.

If either the 'PTB_EXIST' signal or the 'COVER_CLOSED' signal is an "off" signal, the second controller 474 turns off the first controller 472. On the other hand, if both the 'PTB_EXIST' signal and the 'COVER_CLOSED' signal are "on" signals, the second controller 474 turns on the first controller 472. Thus, if either the 'PTB_EXIST' signal or the 'COVER_CLOSED' signal is an off signal, the second controller 474 cuts off all power supplied by the first controller 472 by turning off the first controller 472. By operating the first controller 472 and the second controller 474 in this fashion, since the electrical power supplied to the LSU 400, the electrical power supplied to the sensors 520, 530, 540 and 500, and the control signals supplied to the sensors 520, 530, 540 and 550 and the memory 510 included in the PTB unit 420, are cut off, problems generated by the sensors 520 through 550 and the memory 510 operating in an abnormal environment, such as a cover-open state, are prevented.

According to another embodiment of the present invention, the 'COVER_CLOSED' signal output from the first controller 472 is an "off signal" if either the first or second signals is low. In this case, the second controller 474 turns on or off the first controller 472 using only the 'COVER_CLOSED' signal.

When the second controller 474 turns on the first controller 472 using the 'PTB_EXIST' signal and the 'COVER_CLOSED' signal outputted from the first controller 472, the second controller 474 turns on the first controller 472 after a predetermined time has elapsed from when the second controller 474 receives the 'PTB_EXIST' signal and the 'COVER_CLOSED' signal. This predetermined time delay may be, for instance, after several hundred msec. By delaying turning on the first controller 472, the second controller 474 avoids instantaneously supplying electrical power to the PTB unit 420 and the LSU 400, in order to ensure that the image forming device operates in a stable fashion. More specifically, this predetermined time delay prevents the generation of instantaneous chattering noise immediately after the outer cover 330 is closed, and also prevents the generation of glitch noise at contact points of the connection unit 490, which are instantaneously contacted and released immediately after the PTB unit 420 is installed.

A simplified power control apparatus to control the sensors 520, 530, 540 and 550 and the memory 510 included in the PTB unit 420 will now be described with reference to FIGS. 5 and 6.

The sensors 520, 530, 540 and 550, the memory 510, and the joint board 500 are first described with reference to FIG. 5.

In an embodiment of the present invention, the CR (color registration) sensors 520 and 530 are sensors which sense mismatch information between yellow, magenta, cyan, and black colors in a color image forming device. Additionally, the CR sensors 520 and 530 prevent an inter-color mismatch by detecting inter-color mismatch information through transferring a test pattern onto a PTB corresponding to each color during a self-diagnostic function process of the color image forming device performed before printing, and by compensating for scan timing and a margin of the LSU 400 in a main board.

The home detection optical sensor 540 is preferably, but not necessarily, a photo interrupt sensor to detect a home position of the PTB.

The CTD (conductivity temperature depth) sensor 550 is preferably, but not necessarily, a sensor to sense the depth of color in order to uniformly maintain the depth of color of the color image forming device. The CTD forms a test pattern on the PTB during a self-diagnostic function process similar to the process used by the CR sensors 520 and 530 to form a test pattern, and allows the main board to control color-depth compensation after sensing the depth of color.

The CRUM memory 510 is, preferably, but not necessarily, a semiconductor memory component to store life span information and ID information of the PTB. The life span information of the PTB is information about the number of printable sheets stored, since the PTB is a replaceable part. The ID information is information about a date of manufacture, customer vendors, a serial number, etc.

The joint board 500 preferably, but not-necessarily, includes the CRUM memory 510 and a joint disposed between the sensors 520, 530, 540 and 550 and the CRUM memory 510. The joint board 500 may be configured in ways other than the configuration illustrated in FIG. 5.

Figure 6:
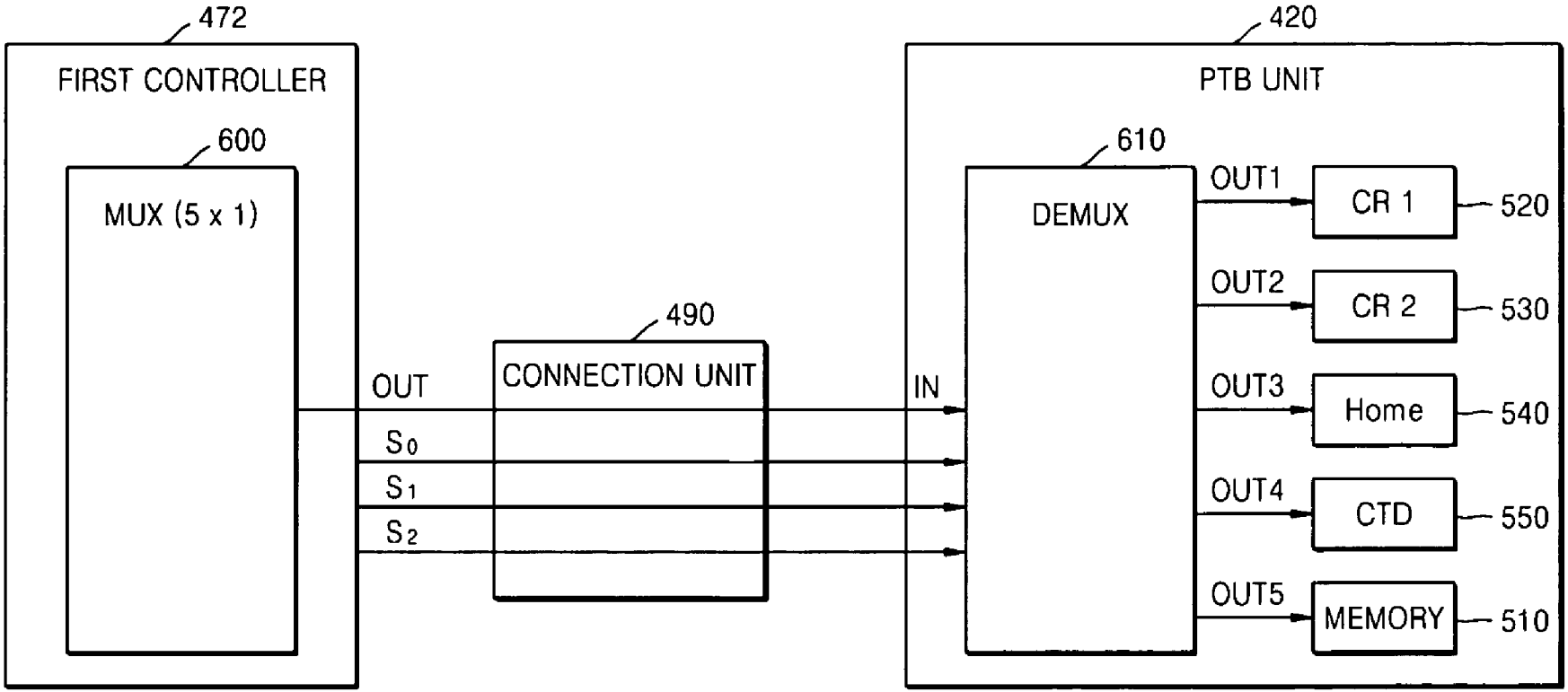
FIG. 6 is a block diagram of a first controller, a connection unit, and the PTB unit included in the power control apparatus illustrated in FIGS. 4 and 5, according to an embodiment of the present invention.

Referring to FIG. 6, the first controller 472 transmits electrical power to the sensors 520, 530, 540 and 550, along with the CRUM memory 510 of the PTB unit 420, via the connection unit 490, and provides control signals used to control the sensors 520, 530, 540 and 550 and the CRUM memory 510 of the PTB unit 420. The first controller 472 also receives output signals from the sensors 520, 530, 540 and 550 and the CRUM memory 510 via the connection unit 490. If the PTB unit 420 includes a large number of sensors and memories, the number of connection lines of the connection unit 490 connecting the first controller 472 to the PTB unit 420 correspondingly increases.

In order to reduce the number of connection lines of the connection unit 490, the first controller 472 according to an embodiment of the present invention includes a multiplexer to receive control signals for sensors and memories in the PTB unit 420, and to output a control signal of a selected unit according to a selection signal for one of the sensors and memories. The PTB unit 420 may further include a demultiplexer to receive the control signal outputted from the multiplexer and to transmit the control signal to the selected unit according to the selection signal. According to this design, since the connection unit 490 only transfers the control signal of the multiplexer and the selection signal to the PTB unit 420, the sensors and memories of the PTB unit 420 are controlled using a smaller number of connection lines than the number of connection lines used in a conventional image forming device.

Referring to FIG. 6, if the PTB unit 420 includes the first CR sensor 520, the second CR sensor 530, the home detection optical sensor 540, the CTD sensor 550, and the CRUM memory 510, the first controller 472 receives first through fifth control signals to control the plurality of sensors 510 through 550 included in the PTB unit 420 via input terminals of a multiplexer 600, and receives a selection signal (a combination of $S_0$, $S_1$, and $S_2$) to select one sensor among the plurality of sensors 510 through 550 via selection terminals of the multiplexer 600. The multiplexer 600 outputs a control signal, which corresponds to a sensor selected using the selection signal, from among the first through fifth control signals in response to the selection signal.

The connection unit 490 transfers the control signal corresponding to the selected sensor, i.e., an output signal of the multiplexer 600, along with the selection signal, to the PTB unit 420.

The PTB unit 420 receives the control signal corresponding to the selected sensor via an input terminal of a demultiplexer 610 and receives the selection signal via selection terminals of the demultiplexer 610. The demultiplexer 610 outputs the control signal corresponding to the selected sensor to the selected sensor among the plurality of sensors 510 through 550 in response to the selection signal.

For example, if a selection signal (a combination of $S_0$, $S_1$, and $S_2$) to select the first CR sensor 520 is "0x000", when the selection signal "0x000" is input to the selection terminal of the multiplexer 600, the multiplexer 600 outputs the first control signal to control the first CR sensor 520 from among the first through fifth control signals in response to the selection signal "0x000".

Next, the connection unit 490 then transfers the first control signal, along with the selection signal "0x000," outputted from the multiplexer 600 to the PTB unit 420.

The PTB unit 420 receives the first control signal via the input terminal of the demultiplexer 610 and the selection signal "0x000" via the selection terminals of the demultiplexer 610. The demultiplexer 610 outputs the first control signal to the first CR sensor 520 in response to the selection signal "0x000".

As described above, if the PTB unit 420 includes a plurality of sensors and memory units, the present invention reduces the number of connection lines of the connection unit 490 by using the multiplexer 600 and the demultiplexer 610. Specifically, the PTB unit 420 using the multiplexer 600 and the demultiplexer 610 does not require preparing connection lines for individual control signals to control the plurality of sensors and memories and to transfer the control signals via the connection lines. This design simplifies a configuration of the connection unit 490 and provides a power control apparatus of an image forming device with reduced manufacturing costs and an efficient layout.

Figure 7:
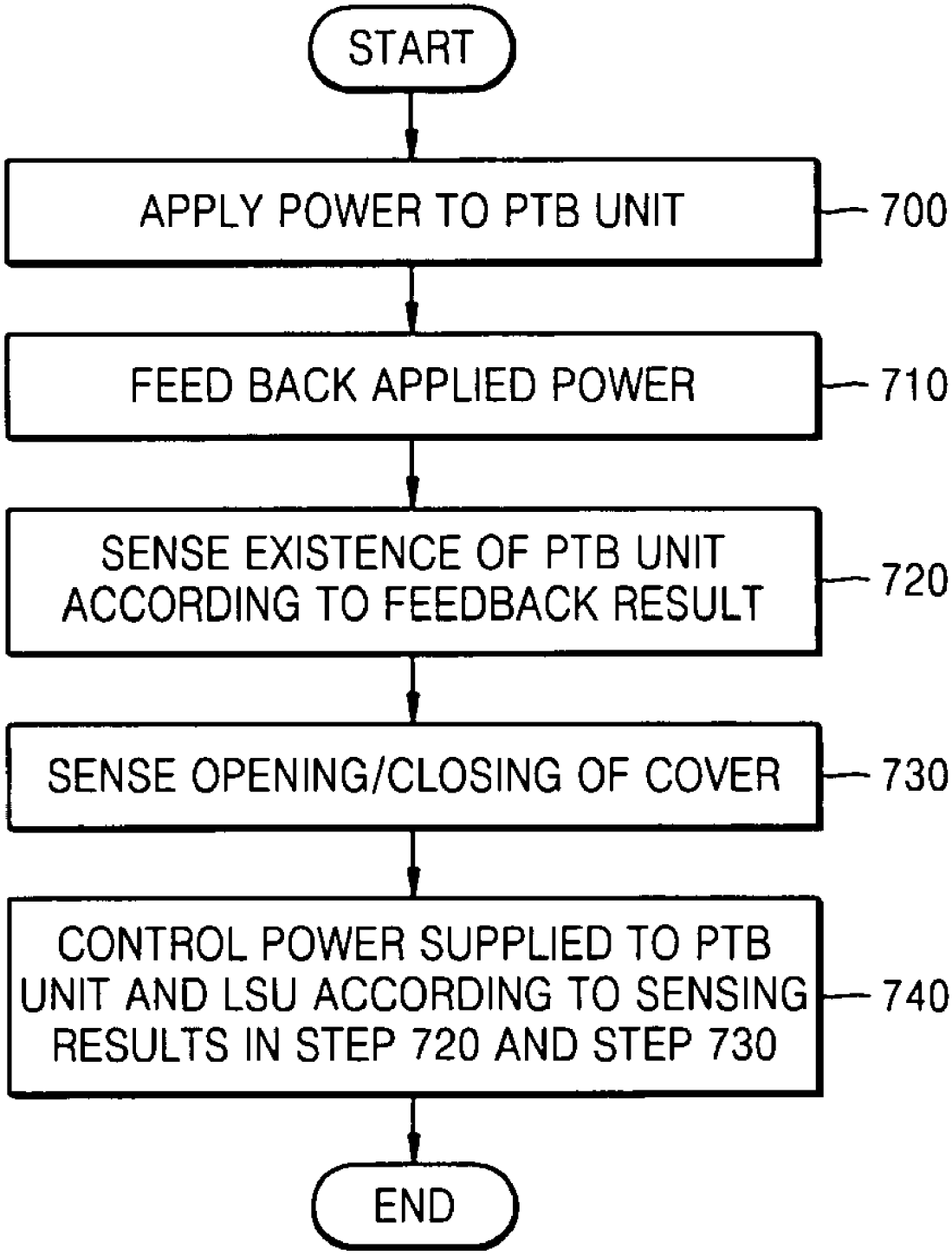
FIG. 7 is a flowchart illustrating a power control method according to an embodiment of the present invention.

A power control method according to an embodiment of the present invention will now be described with reference to FIG. 7. Referring to FIG. 7, in an image forming device, which includes a PTB unit to transfer a developed latent image onto a printing medium, an LSU to scan light onto a photosensitive medium, and a controller to control electrical power supplied to the PTB unit and the LSU, the method of controlling the power supplied to the PTB unit and the LSU includes sensing whether the PTB unit is installed in the image forming device, sensing the opening and closing of a cover door, and controlling the power supplied to the PTB unit and the LSU according to the sensing results.

The controller transmits electrical power of +5V to the PTB unit in operation 700 and feeds the transmitted electrical power back to in operation 710.

The controller senses whether the PTB unit is installed in the image forming device according to the feedback result in operation 720. If the PTB unit is installed in the image forming device, the electrical power transmitted to the PTB unit is fed back to the controller, and if the PTB unit is not installed in the image forming device, the electrical power transmitted to the PTB unit is not fed back to the controller. Thus, the controller senses whether the PTB unit is installed in the image forming device according to a feedback signal of the power transmitted to the PTB unit.

The controller senses the opening and closing of the cover in operation 730. For example, the controller senses the opening and closing of the cover using the cover switch 440 turned off and on in conjunction with the opening and closing of the cover, respectively, which is illustrated in FIG. 4.

In operation 740, the controller cuts off power supplied to the PTB unit and the LSU according to the results sensed by the controller in operations 720 and 730. If the controller senses either that the PTB unit is not installed in the image forming device, or that the cover is open, the power supplied to the PTB unit and the LSU is cut off by turning off the controller in operation 740.

According to an embodiment of the power control method, in operations 700 through 730, the controller first senses whether the PTB unit is installed in the image forming device, and then senses whether the cover is open or closed. In other embodiments, the controller may sense whether the PTB unit is installed in the image forming device after sensing whether the cover is opened or closed, or the controller may simultaneously sense whether the PTB unit is installed in the image forming device and whether the cover is open or closed. In these embodiments, if the controller senses a power cut-off state for either the installation of the PTB unit or the cover, the power supplied to the PTB unit and the LSU is cut off.

As described above, according to aspects of the present invention, since a controller senses whether a PTB unit is installed into an image forming device according to a connection state of the PTB unit by using a simple method which implements a feedback signal corresponding to the electrical power supplied to the PTB unit, and since an LSU is controlled according to whether the PTB unit is installed, a power control apparatus and method of an image forming device is provided which has a simple configuration, reduced manufacturing costs, and a superior layout.

In addition, in order to prevent various kinds of sensors and memory units included in the PTB unit from operating incorrectly and/or operating out of order due to a mistake of a user when the image forming device abnormally operates due to the opening and closing of the outer cover, electrical power supplied to the various kinds of sensors and memory included in the PTB unit is instantaneously cut off according to whether the outer cover of the image forming device is open or closed. Furthermore, the electrical power is supplied back to the various sensors and memory units after a predetermined time has elapsed from when the electrical power is cut off, thus providing a power control apparatus and method of using the power control apparatus in an image forming device which controls electrical power supplied to the PTB unit and the LSU in a stable fashion.

Additionally, aspects of the present invention provide a power control apparatus with low manufacturing costs and a superior layout by simplifying a configuration to control the various kinds of sensors and memory units included in the PTB unit. Specifically, a multiplexer and a demultiplexer are respectively inserted into the first controller and the PTB unit, thereby reducing the number of connection lines needed in a connection unit.

Although a few of the embodiments of the present invention have been shown and described, it would be appreciated by those of skilled in the art that changes may be made in this embodiment without departing from the principles and spirit of the invention, the scope of which is defined in the claims and their equivalents.

What is claimed is:

1. A power control apparatus comprising:

a paper transfer belt (PTB) unit to transfer a developed latent image onto a printing medium;

a laser scanning unit (LSU) to scan light onto a photosensitive medium;

a controller to control power supplied to the PTB unit and the LSU based on a feedback signal of the power transmitted from the controller to the PTB unit; and a connection unit to connect the PTB unit to the first controller, wherein the controller controls the power supplied to the LSU according to a connection state of the connection unit.

2. The power control apparatus of claim 1, wherein the connection unit is used to install the PTB unit in an image forming device and is connected between the PTB unit and the controller in conjunction with the installation of the PTB unit.

3. The power control apparatus of claim 1, wherein the controller receives the feedback signal according to the connection state of the connection unit, senses whether the PTB unit is installed using the feedback signal, and controls the power supplied to the LSU according to the received feedback signal.

4. The power control apparatus of claim 3, further comprising a switch, which is turned on and off when a cover of the image forming device is closed and opened, respectively, wherein the controller controls the power supplied to the LSU according to whether the switch is turned on or off.

5. The power control apparatus of claim 4, wherein the controller receives a second signal according to whether the switch is turned on or off, senses the closing and opening of the cover using the received second signal, and controls the power supplied to the LSU according to the received second signal.

6. The power control apparatus of claim 4, wherein:

the controller is a first controller; and the power control apparatus further comprises a second controller to turn the first controller on and off according to the feedback and second signals.

7. The power control apparatus of claim 1, wherein the connection unit comprises:

a plug;

a receptacle; and a harness pin.

8. A power control apparatus comprising:

a paper transfer belt (PTB) unit to transfer a developed latent image onto a printing medium;

a laser scanning unit (LSU) to scan light onto a photosensitive medium;

a switch, which is turned on and off when a cover of the image forming device is closed and opened, respectively;

a first controller to control power supplied to the PTB unit and the LSU based on a first signal and a second signal, the second signal indicating whether the switch is turned on or off;

a connection unit to connect the PTB unit to the first controller; and a second controller to turn the first controller on and off according to the first and second signals;

wherein the first controller controls the power supplied to the LSU according to a connection state of the connection unit;

wherein the first controller receives the first signal according to the connection state of the connection unit, senses whether the PTB unit is installed using the first signal, and controls the power supplied to the LSU according to the first signal; and wherein, when the second controller turns on the first controller, the second controller turns on the first controller after a predetermined time elapses from when the later of the first and second signals is received by the first controller.

9. The power control apparatus of claim 8, wherein the predetermined time is approximately 200 milliseconds.

10. The power control apparatus of claim 8, wherein the PTB unit comprises a plurality of sensors, wherein the first controller transmits power supplied to the plurality of sensors and transmits a control signal to control the plurality of sensors, and receives output signals outputted from the plurality of sensors.

11. The power control apparatus of claim 10, wherein the first controller further comprises a multiplexer to output the control signal corresponding to a selected one of the plurality of sensors, in response to a selection signal designating the selected one of the plurality of sensors, the connection unit transfers the control signal corresponding to the selected sensor, along with the selection signal, to the PTB unit, and the PTB unit further comprises a demultiplexer to output the control signal corresponding to the selected sensor in response to the selection signal.

12. The power control apparatus of claim 10, wherein the first signal is an output signal outputted from a selected one of the plurality of sensors.

13. A method of controlling power supplied to a paper transfer belt (PTB) unit which transfers a developed latent image onto a printing medium and a laser scanning unit (LSU) which scans light onto a photosensitive medium, in an image forming device comprising the PTB unit and the LSU, the method comprising:

transmitting a portion of the power to the PTB unit;

feeding back the portion of the power transmitted to the PTB unit;

sensing whether the PTB unit is installed in the image forming device; and controlling power supplied to the PTB unit and the LSU according to the sensing result.

14. The method of claim 13, further comprising sensing whether a cover comprised in the image forming device is open or closed.

15. The method of claim 14, wherein the controlling comprises cutting off the power supplied to the PTB unit and the LSU if the PTB unit is sensed not to be installed in the image forming device, or the cover is sensed to be open.

16. A method of controlling power supplied to a paper transfer belt (PTB) unit which transfers a developed latent image onto a printing medium and a laser scanning unit (LSU) which scans light onto a photosensitive medium, in an image forming device comprising the PTB unit and the LSU, the method comprising:

sensing whether the PTB unit is installed in the image forming device; and controlling power supplied to the PTB unit and the LSU according to the sensing result;

wherein the controlling further comprises, if the PTB unit comprises a plurality of sensors, cutting off power and control signals transmitted to the plurality of sensors according to the sensing result.

17. A power control apparatus to be used in an image forming device, comprising:

a paper transfer belt (PTB) unit to transfer a developed latent image onto a printing medium;

a laser scanning unit (LSU) to scan light onto a photosensitive medium;

a controller to control power supplied to the PTB unit and the LSU based on a feedback signal of the power transmitted from the controller to the PTB unit; and a cover;

wherein the LSU turns on when the PTB unit is installed in the image forming device and the cover is closed.

18. The power control apparatus of claim 17, wherein the LSU turns off if either the PTB unit is uninstalled from the image forming device or the cover door is opened.

19. The power control apparatus of claim 17, further comprising a connection unit which connects the PTB unit to the controller when the PTB unit is installed.

20. The power control apparatus of claim 19, wherein the controller receives the feedback signal according to a connection state of the connection unit, senses whether the PTB unit is installed using the feedback signal, and controls the power supplied to the LSU according to the received feedback signal.

21. The power control apparatus of claim 20, further comprising a switch, which is turned on and off when the cover of the image forming device is closed and opened, respectively, wherein the controller controls the power supplied to the LSU according to whether the switch is turned on or off.

22. The power control apparatus of claim 21, wherein the controller receives a second signal according to whether the switch is turned on or off, senses the closing and opening of the cover using the received second signal, and controls the power supplied to the LSU according to the received second signal.

23. The power control apparatus of claim 21, wherein:

the controller is a first controller; and the power control apparatus further comprises a second controller to turn the first controller on and off according to the feedback and second signals.

24. The power control apparatus of claim 19, wherein the connection unit comprises:

a plug;

a receptacle; and a harness pin.

25. A power control apparatus to be used in an image forming device, comprising:

a paper transfer belt (PTB) unit to transfer a developed latent image onto a printing medium;

a laser scanning unit (LSU) to scan light onto a photosensitive medium;

a cover a switch, which is turned on and off when the cover of the image forming device is closed and opened, respectively;

a first controller to control power supplied to the PTB unit and the LSU based on a first signal and a second signal, the first signal indicating a connection state of the connection unit and the second signal indicating whether the switch is turned on or off;

a connection unit which connects the PTB unit to the first controller when the PTB unit is installed; and a second controller to turn the first controller on and off according to the first and second signals;

wherein the LSU turns on when the PTB unit is installed in the image forming device and the cover is closed;

wherein the first controller senses whether the PTB unit is installed using the received first signal, and controls the power supplied to the LSU according to the received first signal; and wherein, when the second controller turns on the first controller, the second controller turns on the first controller after a predetermined time elapses from when the later of the first and the second signals is received by the first controller.

26. The power control apparatus of claim 25, wherein the predetermined time is approximately 200 milliseconds.

27. The power control apparatus of claim 25, wherein the PTB unit comprises a plurality of sensors, wherein the first controller transmits power supplied to the plurality of sensors and transmits a control signal to control the plurality of sensors, and receives output signals outputted from the plurality of sensors.

28. The power control apparatus of claim 27, wherein the first controller further comprises a multiplexer to output the control signal corresponding to a selected one of the plurality of sensors, in response to a selection signal designating the selected one of the plurality of sensors, the connection unit transfers the control signal corresponding to the selected sensor, along with the selection signal, to the PTB unit, and the PTB unit further comprises a demultiplexer to output the control signal corresponding to the selected sensor in response to the selection signal.

29. The power control apparatus of claim 27, wherein the first signal is an output signal outputted from a selected one of the plurality of sensors.

* * * * *